United States Patent [19]

Marshall

[11] 4,060,029

[45] Nov. 29, 1977

[54] BOUNCE-FREE OBJECT ARRESTING SYSTEM

[75] Inventor: Robert Marshall, Sheffield, England

[73] Assignee: Davy-Loewy Limited, Sheffield, England

[21] Appl. No.: 699,327

[22] Filed: June 24, 1976

[30] Foreign Application Priority Data

June 24, 1975 United Kingdom ..... 26791/75

[51] Int. Cl.[2] ..... B21B 45/00; B44B 5/00

[52] U.S. Cl. ..... 101/4; 101/93.02; 173/131; 188/268; 267/182

[58] Field of Search ..... 101/4, 93.02; 267/136, 267/182; 188/268; 145/29 B; 16/83; 272/76; 124/61, 68; 173/131, 128, 100, 99, 98, 102; 125/40; 73/379, 12, 13; 35/19 R

[56] References Cited

U.S. PATENT DOCUMENTS

| | | | |
|---|---|---|---|
| 2,821,398 | 1/1958 | Armstrong | 73/379 UX |
| 3,232,596 | 2/1966 | Kleinschmidt et al. | 188/268 X |
| 3,594,925 | 7/1971 | Abbat | 35/19 R |

FOREIGN PATENT DOCUMENTS

| | | | |
|---|---|---|---|
| 33,371 | 10/1921 | Norway | 173/131 |
| 1,319,973 | 6/1973 | United Kingdom | 101/4 |
| 1,428,385 | 3/1976 | United Kingdom | 101/4 |

*Primary Examiner*—Clifford D. Crowder
*Attorney, Agent, or Firm*—Brisebois & Kruger

[57] ABSTRACT

An arrester system for arresting without substantial bounce a moving object, such as the arm of a billet stamper, is constituted by a housing mounting at one end a steel ball which is struck by the moving object. The housing also guides an axially movable steel cylinder which is normally in contact with the steel ball but is driven away from it on impact of the moving object with the ball. The housing further carries a hydraulic or resilient energy absorber which has a piston rod which extends parallel to the movement of the cylinder and which is struck by the cylinder when the latter is driven away from the steel ball. The ball and cylinder form an energy transforming device, the energy of the moving object being transferred via the ball to the cylinder, which in turn transfers the energy to the energy absorber in the direction of the piston rod. Energy transfer is effected without movement of the steel ball and without any substantial bounce of the object.

9 Claims, 2 Drawing Figures

BOUNCE-FREE OBJECT ARRESTING SYSTEM

This invention relates to an arresting system designed to arrest a moving body, without substantial bounce.

One application requiring such an arresting system is a billet stamper used to stamp identifying numbers or letters on billets in steelworks. A billet stamper is effectively a pendulum carrying the stamp at the lower end; when the stationary stamp is struck by a moving billet, it is driven out of the path of the billet and against a shock absorber which should absorb the stampers' kinetic energy. The billet stamper then swings back and is arrested by a stop at bottom dead centre in the path of the next billet.

Existing shock absorbers used for billet stampers are not effective in bringing the stamper to rest without bounce, and in practice the stamper recoils from the shock absorber and reaches its bottom dead centre with a velocity considerably higher than that due to gravity alone. The stamper is thus subject to substantial shock three times in each cycle of use - when struck by the billet, when it strikes the shock absorber at the top of its swing, and when it strikes the stop at the bottom of its return path. The operational life of a stamper is consequently uneconomically short.

An object of the invention is to provide an arresting system capable of arresting a moving object, such as a billet stamper, without substantial bounce, and, according to the invention such a system includes an energy absorber and an energy transmitting system which comprises a first elastic element arranged to be struck by a face of the moving object and a second elastic element normally interposed between the first element and the energy absorber, the second element being normally in engagement with the first element but movable away from the first element into contact with the energy absorber when the first element is struck by the striking face, the coefficients of restitution between the striking face of the moving object and the first element and between the first and second elements being high.

Particularly when the moving object is a billet stamper, the striking face is constituted by a spherical, or part-spherical insert. Similarly the first element may be a body having faces which in section are circular, or part-circular, such as a sphere or roller.

When the object strikes the first element, its kinetic energy is transferred to that element, which in turn transfers it to the second element and the energy absorber; the moving object is brought substantially to standstill, while the first element itself remains motionless. The second element however moves away from the first element with a speed dependent on the moving object's momentum before collision and is brought to rest quickly by the energy absorber.

The invention will be more readily understood by way of example from the following description of an arresting system for a billet stamper, reference being made to the accompanying drawing, in which.

Figure 1:
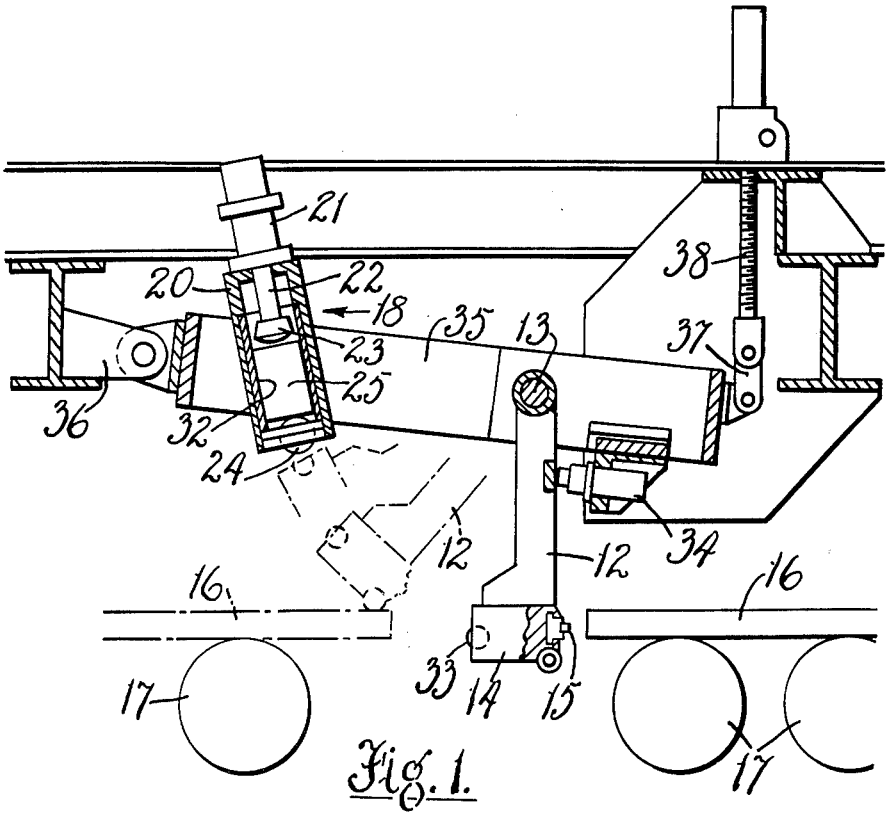
FIG. 1 shows the arresting system and the billet stamper in side view.

The billet stamper comprises a pendulum arm 12 pivotally mounted at its upper end on pin 13 and having at its lower end a head 14 carrying a stamp 15. When the billet stamper is in the rest position shown in full line, the stamp 15 lies in the path of billet 16 moving from right to left on a roller table represented by rollers 17. When struck by such a billet, the stamper swings out about pin 13 with high velocity as illustrated in chain line and strikes an arrester system 18.

The arrester system consists of a housing 20 carrying at its upper end an energy absorber 21 in the form of a hydraulic shock absorber of known type. The piston rod 22 of the absorber 21 extends axially within the housing 20 and terminates in a bumper head 23. Energy is transferred from the stamper to the absorber 21 by a first hard, highly elastic, element in the form of a steel ball 24 mounted in an opening in the lower end of housing 20, and a second hard, highly elastic, element in the form of a steel cylinder 25 which is a close sliding fit within the housing. Normally, the cylinder 25 is located in contact with ball 24 and closely adjacent bumper head 23.

Figure 2:
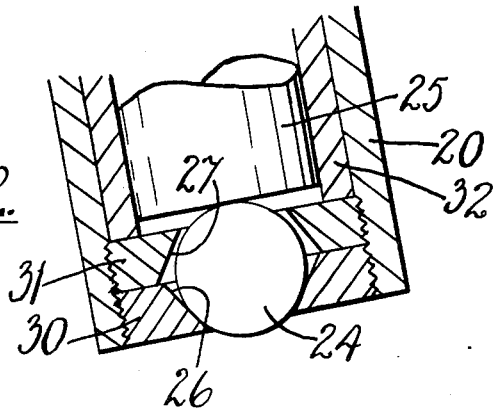
FIG. 2 shows part of the arresting system to a larger scale.

As seen clearly in FIG. 2, ball 24 is retained in the lower end of housing 20 between conical faces 26, 27 formed in ring members 30, 31, which are screw threaded into the end of housing 20. A bush 32 within the cylindrical housing 20 provides a sliding bearing for the cylinder 25.

The stamper head 14 has a striker formed by a second steel ball 33 inset into the face directed away from the stamp 15, the housing 20 being so located that, when the billet stamper is driven clockwise by being struck by a billet 16, the ball 33 strikes the ball 24 centrally. When that occurs the kinetic energy of the stamper is wholly transferred to the ball 24 and thence to the cylinder 25; because the balls 24, 33 and the cylinder 25 are highly elastic and because the coefficients of restitution of the striking surfaces are also high, the billet stamper is brought to rest without recoil, ball 24 remains motionless and cylinder 25 is driven away from ball 24 at a speed dependent on its mass and the momentum of the stamper before impact. The cylinder 25 which moves parallel to the axis of piston rod 22 is then brought to rest by absorber 21 which after a delay returns the cylinder to its initial position. The cylinder 25 falls under gravity and is brought to rest in contact with the ball 24.

Having been arrested, the billet stamper falls under gravity to the bottom of its path where it is again arrested by a stop 34. As its velocity when arrested by the stop is only that due to its fall under gravity and contains no component due to recoil from the arrester system 18, the stamper is subjected to little shock.

The balls 24, 33 may be replaced by steel rollers, in the form of roller bearings or other bodies having part-spherical or part-cylindrical impact surfaces.

To reduce the momentum of the billet stamper, the pendulum arm 12 may be of skeletal form. In order that the height of the stamp 15 may be adjusted to the path of the billets 16, the pin 13 of the pendulum 12 is carried on an arm 35 which is pivotally mounted at one end on a bracket 36 and which is attached at the other end to a shackle 37 carried at the end of a screw 38. Rotation of the screw 38 lifts or lowers the connected end of the arm 35 and hence adjusts the vertical position of pendulum pin 13.

I claim:

1. An arresting system for arresting without substantial bounce an arcuately moving object having a striking face, the system including:

a. a linear guideway;

b. an energy absorber disposed at one end of said guideway;

c. said energy absorber having a piston rod extending axially of said guideway towards the other end of said guideway;

d. a first elastic element disposed at the other end of said guideway and in the path of said moving object so as to be struck by said striking face; and e. a second elastic element which is a close sliding fit within said guideway between said piston rod and said first elastic element, and which is normally in contact with said first element until said first element is struck by said striking face, f. the coefficients of restitution between said first and second elements and between said striking face and said first element being high, whereby the kinetic energy of said moving object is transferred to said second element and thence to said energy absorber without substantial movement of said first element.

2. An arresting system as claimed in claim 1, in which said first element is a steel member having part-cylindrical faces for contact with said striking face and said second element.

3. An arresting system as claimed in claim 1, in which said first element is a steel member having part-spherical faces for contact with said striking face and said second element.

4. An arresting system as claimed in claim 1, in which said second element is a steel cylinder which is mounted for axial movement.

5. An arresting system as claimed in claim 1, in which said energy absorber is hydraulic.

6. Billet stamping equipment comprising a. a pivotally mounted pendulum arm;

b. a stamp carried by said arm adjacent its lower end;

c. an elastic striking face on said arm adjacent its lower end;

d. a housing defining a linear guideway;

e. a first elastic element mounted in said housing at one end of said guideway;

f. said housing and said first element being positioned for engagement of said first element by said striking face when said arm is driven;

g. a second elastic element which is a close sliding fit within said guideway and which is normally in contact with said first elastic element; and h. an hydraulic energy absorber carried by said housing, i. said energy absorber having a piston rod extending into said guideway in the direction of sliding movement of said second element from said first element, j. the coefficients of restitution between said first and second elements, and between said striking face and said first element being high.

7. Billet stamping equipment as claimed in claim 6, in which said first element and said striking face are constituted by steel balls.

8. Billet stamping equipment as claimed in claim 6, in which said second element is a steel cylinder mounted for axial movement in said path.

9. Billet stamping equipment as claimed in claim 6, in which said piston rod carries a bumper head which is normally closely adjacent said second element.

* * * * *